US005090317A

United States Patent [19]

Lubke et al.

[11] Patent Number: 5,090,317

[45] Date of Patent: Feb. 25, 1992

[54] DOCTOR BLADE DEVICE

[75] Inventors: Herbert Lubke, Lienen; Volker Schröder, Lengerich; Wolfgang Knapheide, Lienen, all of Fed. Rep. of Germany

[73] Assignee: Windmoller & Holscher, Lengerich, Fed. Rep. of Germany

[21] Appl. No.: 586,780

[22] Filed: Sep. 24, 1990

[30] Foreign Application Priority Data

Sep. 27, 1989 [DE] Fed. Rep. of Germany ..... 3932232

[51] Int. Cl.[5] ..... B41F 9/10; B41F 31/04; B41L 27/06

[52] U.S. Cl. ..... 101/169; 101/363

[58] Field of Search ..... 101/157, 169, 152, 153, 101/365, 366, 349, 350, 363; 118/261, 262; 15/256.51

[56] References Cited

U.S. PATENT DOCUMENTS 3,780,670 12/1973 Abler et al. ..... 101/169

FOREIGN PATENT DOCUMENTS 0251139 10/1987 Japan ..... 101/169

*Primary Examiner*—J. Reed Fisher

*Attorney, Agent, or Firm*—Fleit, Jacobson, Cohn, Price, Holman & Stern

[57] ABSTRACT

A doctor blade, secured in a pivoting doctor blade holder, of a doctor blade device is able to be engaged with a roll accepting ink, such as the gravure image carrier cylinder of gravure press, at an adjustable angle. In order to reliably and rapidly reset the angle of engagement, the line of engagement and also the engagement thrust of the doctor blade on the fold, and in addition to perform such adjustment even while the press is running, the doctor blade holder is pivotally mounted in elongate, which itself is pivotally mounted at its opposite ends on carrying members, the carrying members are mounted for linear adjustment in unison in the machine frame. The doctor blade holder and the elongate frame are provided with pivotal drive assemblies and the carrying members are provided with linear drives, which an all be operated from a central control device.

6 Claims, 4 Drawing Sheets

DOCTOR BLADE DEVICE

BACKGROUND OF THE INVENTION

This invention relates to a doctor blade device having a doctor blade secured in a pivoting holder for engagement at an adjustable angle with an inked roll, such as the gravure image carrier cylinder of a gravure printing press.

In a doctor blade device for a gravure press as disclosed in German patent publication 1,941,595 A, the doctor blade holder is able to pivot on a doctor blade carrier along a circular arc centered on the knife edge of the doctor blade, so that when the doctor blade holder is pivoted there is an alteration of the angle of the doctor blade relative to the gravure image carrier cylinder which takes place without changing the line of contact of the doctor blade on this cylinder.

If inks of different viscosity and different drying properties are processed, it is not only the angle of engagement of the doctor blade on the cylinder but also the position of the line of contact of the edge of the doctor blade on the cylinder which are important, since this position affects the drying of the ink. Thus while the position of the line of contact of the doctor blade on the gravure image carrier cylinder affects the degree of drying, the degree of filling of the etch depressions in the cylinder with ink depends on the engagement angle of the doctor blade. In order to effect high quality printing it is therefore not only necessary to set the engagement angle of the doctor blade but also the position of the line of engagement of the doctor blade on the cylinder right from the start of a run.

SUMMARY OF THE INVENTION

One object of the present invention is to provide a doctor blade device of the type described in which the angle of engagement and the position of the line of engagement of the doctor blade on the roll and furthermore the engagement thrust of the doctor blade on the roll may be reliably and rapidly set, even while the press is running.

In accordance with the invention, the doctor blade holder is pivotally mounted in a frame, which for its part is pivotally mounted in carrying members, which are guided in the frame for ganged, i.e. synchronous, linear adjustment, the doctor blade holder and the frame being provided with rocking drives and the carrying members being provided with linear drives, operable from the a central control device. The doctor blade holder is able to move in parallelism to itself linearly and also is able to perform rocking motion about two parallel axes of rocking so that the doctor blade may be engaged with the roll at any desired angle and in a predetermined circumferential area of the roll in different settings. In addition the thrust of the doctor blade on the roll may be adjusted.

The doctor blade device in accordance with the invention thus makes it possible to vary the degree of filling of the etch depressions in the gravure image carrier cylinder and the drying time of the ink. Thus it becomes possible to do high quality printing whatever the drying properties of the respective ink being used.

A further advantage of the doctor blade device in accordance with the invention is that the device may be automatically adjusted in different diameters of the rolls and of the gravure image carrier cylinder.

The central control device may be a central computer, which controls the pivotal and linear drives in accordance with a suitable program.

In accordance with a further feature of the invention, the parallel pivot shafts of the doctor blade holder and of the frame have levers, on whose ends drive nuts, adapted to rock about axes parallel to the pivot shafts, are pivoted. Drive screws are screwed into the drive nuts and are connected by universal joints with drive shafts, which are adapted to be driven, either directly or via transmissions, by electric motors.

The doctor blade device may furthermore be so designed that the drive shafts are journalled in bearings on the frame or, respectively, in the carrying member and the carrying member may be provided with drive screw nuts, which receive drive screws which are mounted in their ends in the frame. The drive screws may be adapted to be driven in unison by bevel gearing connected with a shaft, which is able to be driven by a geared motor.

DESCRIPTION OF PREFERRED EMBODIMENT

Figure 1:
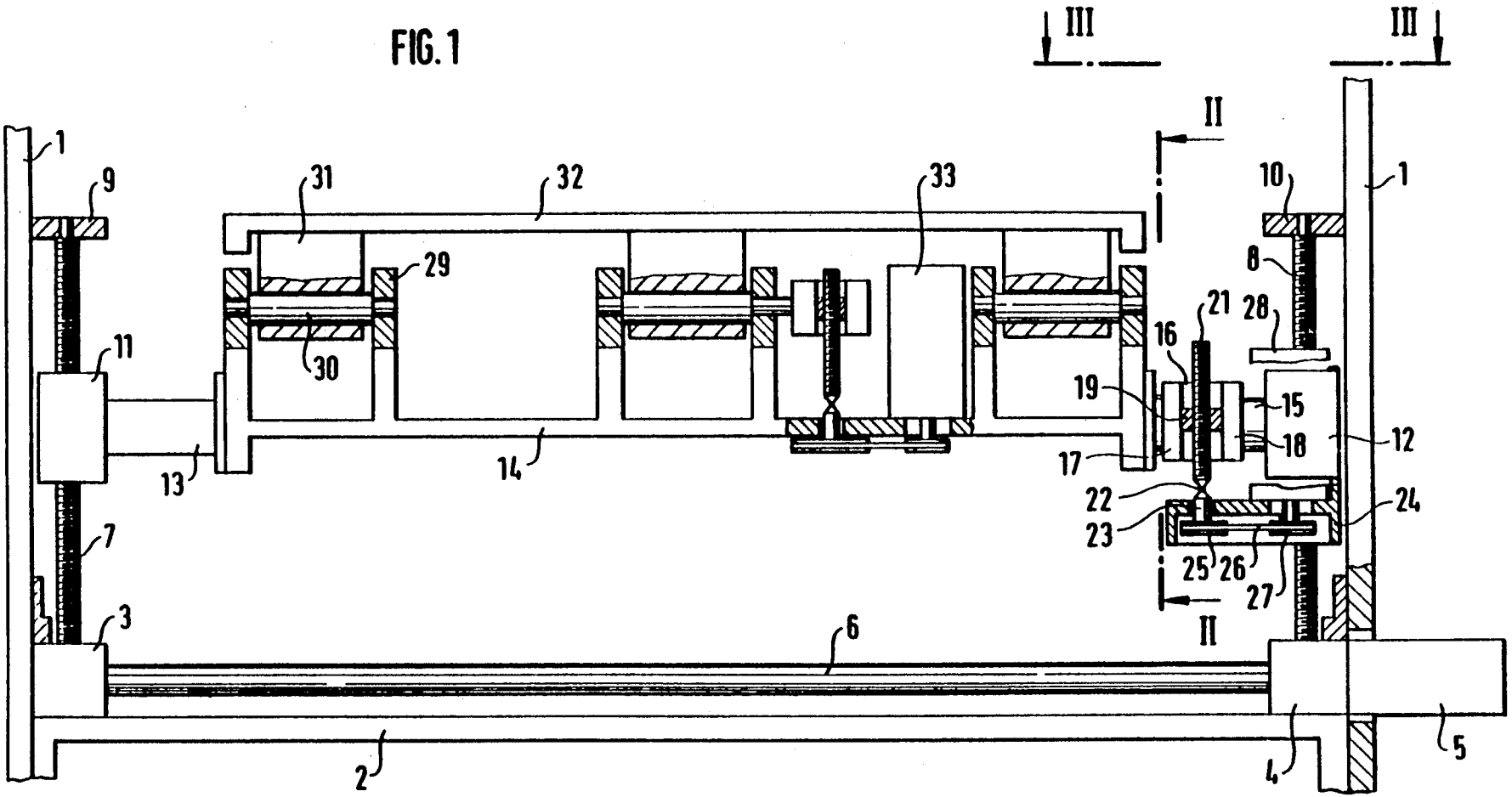
FIG. 1 is a partly front view of a doctor blade device partly in section.
Figure 3:
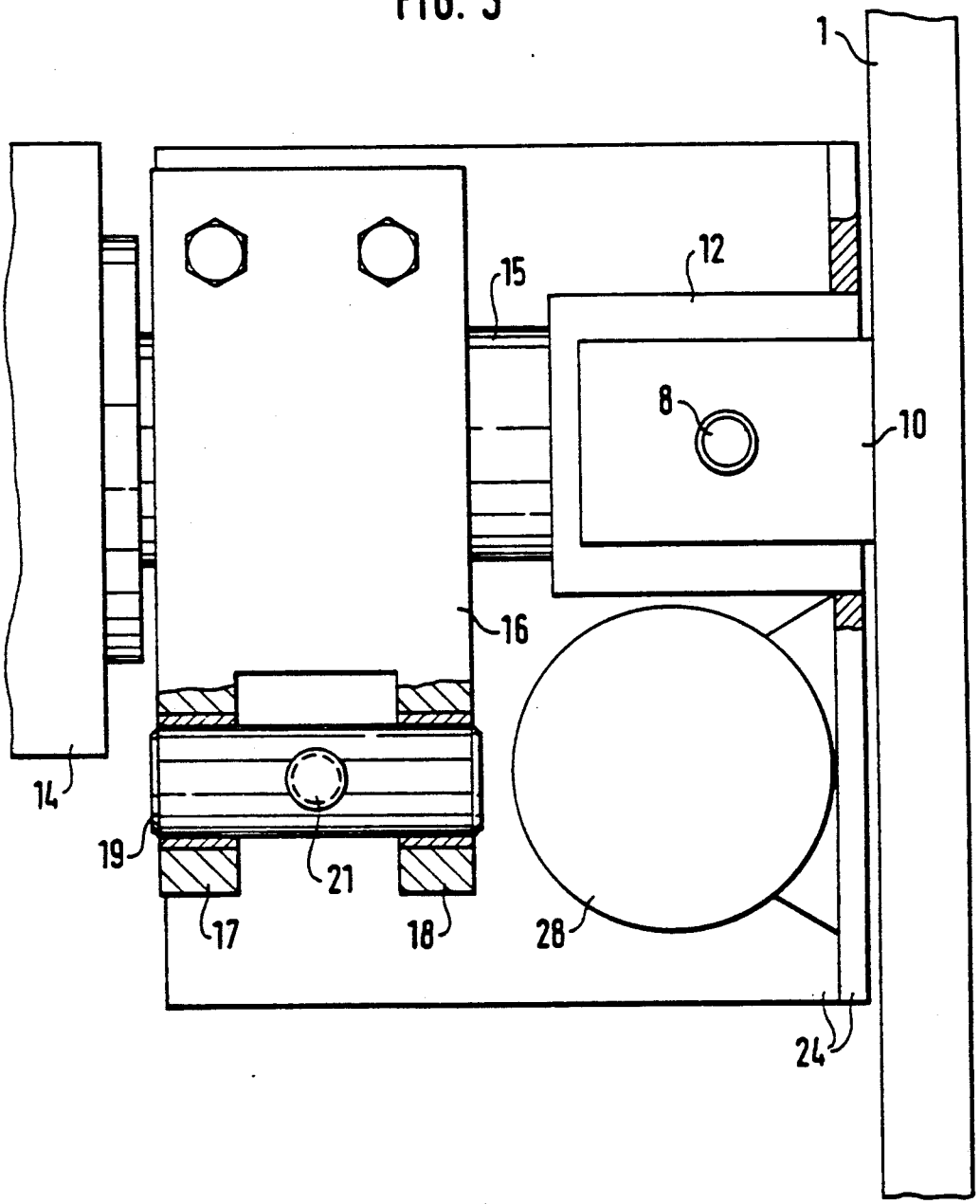
FIG. 3 is a plan view of the doctor blade device as seen in the direction of arrows III in FIG. 1.

Two side walls of the a machine frame are connected together by means of a cross beam 2. Transmissions 3 and 4 are screwed to the respective walls 1 on the inner surfaces thereof, the transmission 4 being connected with a motor 5. Via a shaft 6, the transmissions 3 and 4 are connected together. Drive screws 7 and 8 are arranged to be driven from the motor 5 by way of the transmissions 3 and 4 are supported at their ends, which are remote from the transmissions 3 and 4 by way of brackets 9 and 10 connected to the side walls. Carriers 11 and 12 are mounted on the drive screws by way of drive nuts not shown. A trunnion 13 is rotatably mounted in the bearing 11 shown on the left hand side of FIG. 1 and is rigidly connected with one side of a cast frame 14. A similar trunnion 15 is rotatably mounted to the carrier 12 on the right hand side of the FIG. 1. The end of the trunnion 15 remote from the carrier 12 is rigidly fixed to the right hand side of the cast frame 14. The trunnion 15 on the right hand side of FIG. 1 carries a gripping lever 16 whose end nearer the observer in FIG. 3 is forked. A pin 19 is journalled in the two forked arms 17 and 18, and the pin has a central threaded hole with a drive screw 21 screwed into it. The drive screw at its lower end (FIG. 1) has a universal joint 22 with a stub shaft 23, which is mounted in a carrying member 24 so that shaft 23 is located axially while being able to rotate. The end of the stub shaft 23 remote from the joint 22 mounts a belt pulley 25, which is connected via a V-belt 26 with a further pulley 27. The latter, namely the pulley 27, is driven by a motor 28, which is firmly mounted on the carrying member 24. The carrying member 24 is attached to the carrier 12.

By operating the motor 5 it is accordingly possible to move the two bearings 11 and 12 upwardly and downwardly so that by way of the trunnions 13 and 15 the cast frame 14 may also be raised and lowered. By additionally operating the motor 28 (see FIG. 3) it is possible for the cast frame 14 to be rocked about the axis of the trunnions 13, 15 via the drive screw 21, the pin 19 and the gripping lever 16.

The cast frame 14 has a plurality of spaced supports 29, which between adjacent pairs, carry respective shafts 30. Arms 31 are journalled on the three shafts 30 and are firmly connected with doctor blade holder 32. A further motor 33 is flange-mounted on the cast frame 14 by which the doctor blade holder 32 may be rocked in relation to the cast frame 14 through a screw 33*a* and a lever 33*b* similar to lever 16. This rocking motion is performed in a manner similar to the rocking of the cast frame 14 using the motor 28 so that a separate account of such rocking action is not required.

Figure 2:
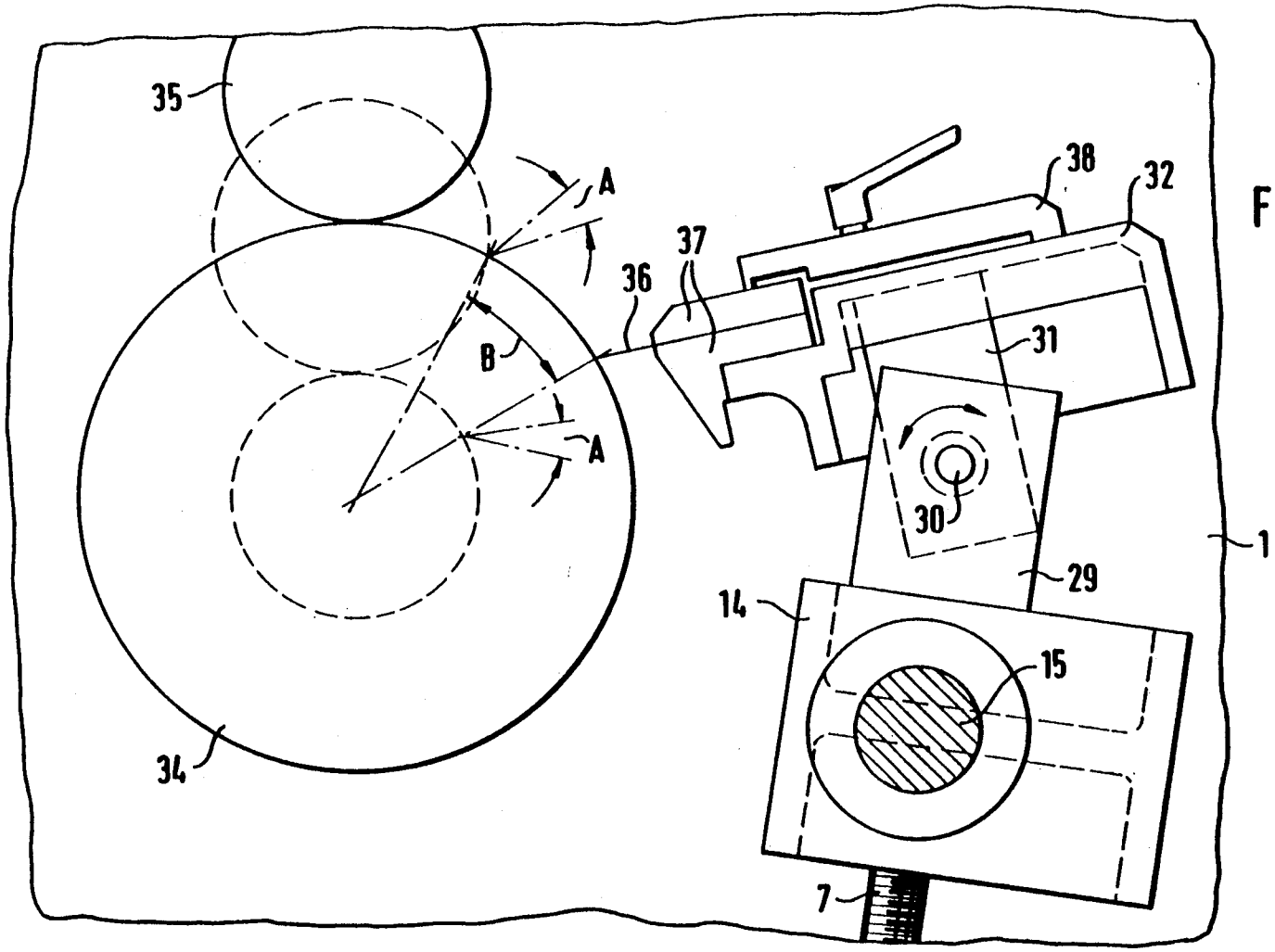
FIG. 2 is a sectional view on the line II-II of FIG. 1.

In FIG. 2 a gravure image carrier cylinder 34 and an impression roll 35 are marked in full lines. The doctor blade 36 is in engagement with the image cylinder 34, said blade being connected via a gripping member 37 and a clip 38 with the doctor blade holder 32. By suitable operation of the motors 5, 28 and 33 it is possible on the one hand to move the doctor blade through the angle B, which has an influence on the degree of drying of the ink. (The farther the doctor blade is from the impression roll, the longer the distance to be moved through by the doctored depressions in the gravure image carrier cylinder before they reach to the impression roll so that a high degree of drying is achieved). Further by suitable operation of the three motors it is possible to set doctor blade within the angle A. (The smaller the angle A, the greater the degree of filling of the depressions.

Figure 4:
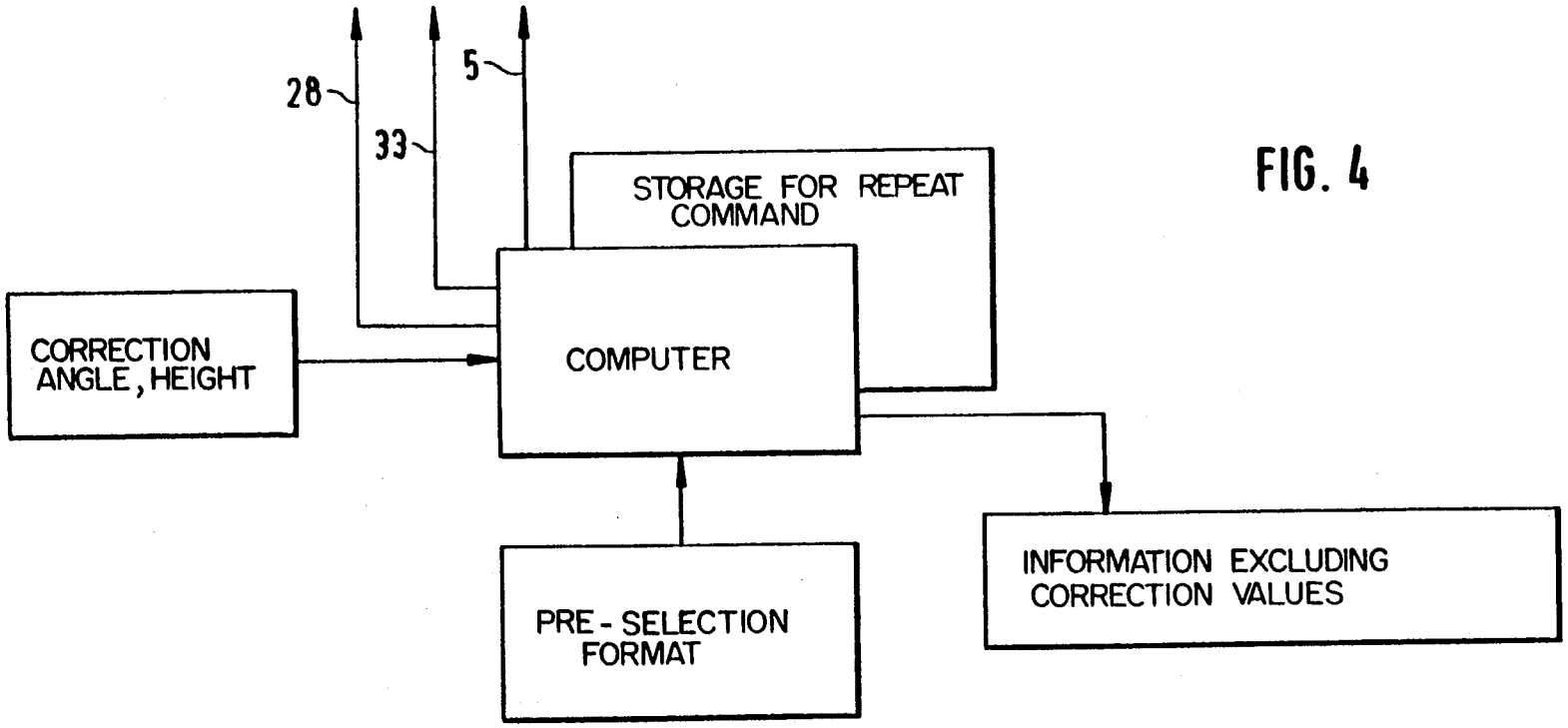
FIG. 4 is a block circuit diagram of a control device for the doctor blade device.

FIG. 4 represents a block circuit diagram of the NC system of the doctor blade device. The main part of the control system is formed by a computer which operates the servo motors 5, 28 and 33. Customized programs are available to set the angle of engagement and the line of engagement and also be engagement thrust of the doctor blade on the gravure image cylinder. There are further customized programs which make it possible to reset the doctor blade automatically to an altered diameter of the gravure image carrier cylinder when the cylinder is changed.

The programs comprise additional program parts for predetermined printing orders so that such data may be retrieved in a simple manner.

What is claimed is:

1. A doctor blade device having a doctor blade secured in a doctor blade holder for engagement at an adjusted angle with an inked roll, wherein the doctor blade holder is pivotally mounted on an elongate frame which is itself pivotally mounted at its opposite ends in respective carrying members, a further frame in which the carrying members are mounted for linear adjustment in unison, a first drive assembly including a first servo-motor for pivotally adjusting the doctor blade holder on the elongate frame, a second drive assembly including a second servo-motor for pivotally adjusting the elongate from one the carrying members, drive means including a third servo-motor for linearly adjusting the positions of the carrying members and a central control unit for operating the first, second and third servo-motors.

2. The device as claimed in claim 1 wherein the carrying members are mounted for linear movement on parallel drive screws carried in the further frame, and the drive means comprises gearboxes connected to the drive screws, and a drive shaft connecting the gearboxes, the third servo-motor being connected to one of the gearboxes.

3. A doctor blade device having a doctor blade secured in a doctor blade holder for engagement at an adjusted angle with an inked roll, wherein the doctor blade holder is pivotally mounted on an elongate from which is itself pivotally mounted at its opposite ends in respective carrying members, a further frame in which the carrying members are mounted for linear adjustment in unison, a first drive assembly for pivotally adjusting the doctor blade holder on the elongate frame, a second drive assembly for pivotally adjusting the elongate frame on the carrying members and drive means for linearly adjusting the positions of the carrying members wherein the first drive assembly comprises a pivot shaft connected between the doctor blade carrier and the elongate frame, a lever attached to the pivot shaft, a screw threaded with the lever substantially perpendicular to the pivot shaft and a first motor for rotating the screw, the lever being fixed with respect to one of the doctor blade carrier and the elongate frame and the first motor being mounted on the other of the doctor blade carrier and the elongate frame.

4. The device as claimed in claimed claim 3 wherein the motor is connected to the screw by a motor driven stub shaft and a universal joint between the screw and the stub shaft.

5. A doctor blade device having a doctor blade secured in a doctor blade holder for engagement at an adjusted angle with an inked roll, wherein the doctor blade holder is pivotally mounted on an elongate frame which is itself pivotally mounted at its opposite ends in respective carrying members, a further frame in which the carrying members are mounted for linear adjustment in unison, a first drive assembly for pivotally adjusting the doctor blade holder o the elongate frame, a second drive assembly for pivotally adjusting the elongate frame on the carrying members and drive means for linearly adjusting the positions of the carrying members wherein the second drive assembly comprises a trunnion connected between the elongate frame and one of the carrying members, a lever fixed on the trunnion, a screw threaded with the lever perpendicular to the trunnion and a drive motor for rotating the screw, the lever being fixed with respect to the elongate frame and the motor being fixed with respect to said one of the carrying members.

6. The device as claimed in claim 5 wherein the motor is connected to the screw by a motor driven stub shaft and a universal joint between the stub shaft and the screw.

* * * * *